United States Patent [19]

Urs

[11] Patent Number: 4,815,349

[45] Date of Patent: Mar. 28, 1989

[54] ANGLE SHEAR FOR CUTTING A SHEET METAL PLATE IN TWO DIRECTIONS

[75] Inventor: Wälchli Urs, Brittnau, Switzerland

[73] Assignee: Hammerle AG, Zofingen, Switzerland

[21] Appl. No.: 125,196

[22] Filed: Nov. 25, 1987

[30] Foreign Application Priority Data

Dec. 1, 1986 [AT] Austria ..... A 3195/86

[51] Int. Cl.[4] ..... B26D 7/06; B26D 1/12

[52] U.S. Cl. ..... 83/404; 83/408; 83/693

[58] Field of Search ..... 83/404, 408, 632, 692, 83/693

[56] References Cited

U.S. PATENT DOCUMENTS

| | | | |
|---|---|---|---|
| 3,465,671 | 9/1969 | McPherson | 83/632 |
| 3,620,112 | 11/1971 | Jonemann | 83/632 X |
| 4,485,714 | 12/1984 | Eriksson | 83/632 X |
| 4,494,428 | 1/1985 | Malof | 83/693 X |
| 4,506,573 | 3/1985 | Tobita | 83/693 X |
| 4,535,665 | 8/1985 | Fazis | 83/693 X |
| 4,641,555 | 2/1987 | Johnson et al. | 83/408 X |

*Primary Examiner*—William L. Sikes
*Assistant Examiner*—Akm E. Ullah
*Attorney, Agent, or Firm*—Tarolli, Sundheim & Covell

[57] ABSTRACT

An angle shear for cutting a sheet metal plate in two directions shear comprises a feed table, associated therewith longitudinal and transverse cutting blades guide means, and a rotary device arranged above the feed table. Longitudinal feeding means can be retracted from the work position to a position beneath the table level and are arranged in a transverse row. Transverse feeding means can be arranged at the table level and forms a longitudinal row. Both the longitudinal and transverse feeding means cooperate with side stops, which are arranged and distributed within a plane extending in longitudinal and transverse direction. The angle shear provides for automatic feeding of sheets and stacking at several stations.

5 Claims, 3 Drawing Sheets

ANGLE SHEAR FOR CUTTING A SHEET METAL PLATE IN TWO DIRECTIONS

BACKGROUND AND SUMMARY OF THE INVENTION

The present invention relates to a angle shear for cutting a sheet metal plate in two directions; shear comprising a feed table and associated therewith longitudinal and transverse knives. The shear further comprises longitudinal and transverse feeding means, and a rotating device arranged above the feed table.

An angle shear comprising an L-shaped table, longitudinal and transverse knives, as well as longitudinal and transverse feeding means, is known. The known angle shear is used for rapid and reliable separation of metal sheet stock into individual plates.

According to the present invention, there is provided an angle shear which enables automatic cutting of metal sheets from stocks. The shear can be used universally for producing rectangular large panels, as well as strips and small plates. A high accuracy of cutting is guaranteed. In particular, cutting plates in one run is possible.

Preferably, a stacking device can be provided after both the longitudinal cutting blade and the transverse knife. At least one stacking device comprises conveyor belt means movable forward an backward and cutting which can be lowered and raised with the movement of the cutting blade.

The attached drawings show one embodiment of an angle shear according to the invention. In the drawings:

DESCRIPTION OF THE PREFERRED EMBODIMENT

Figure 1:
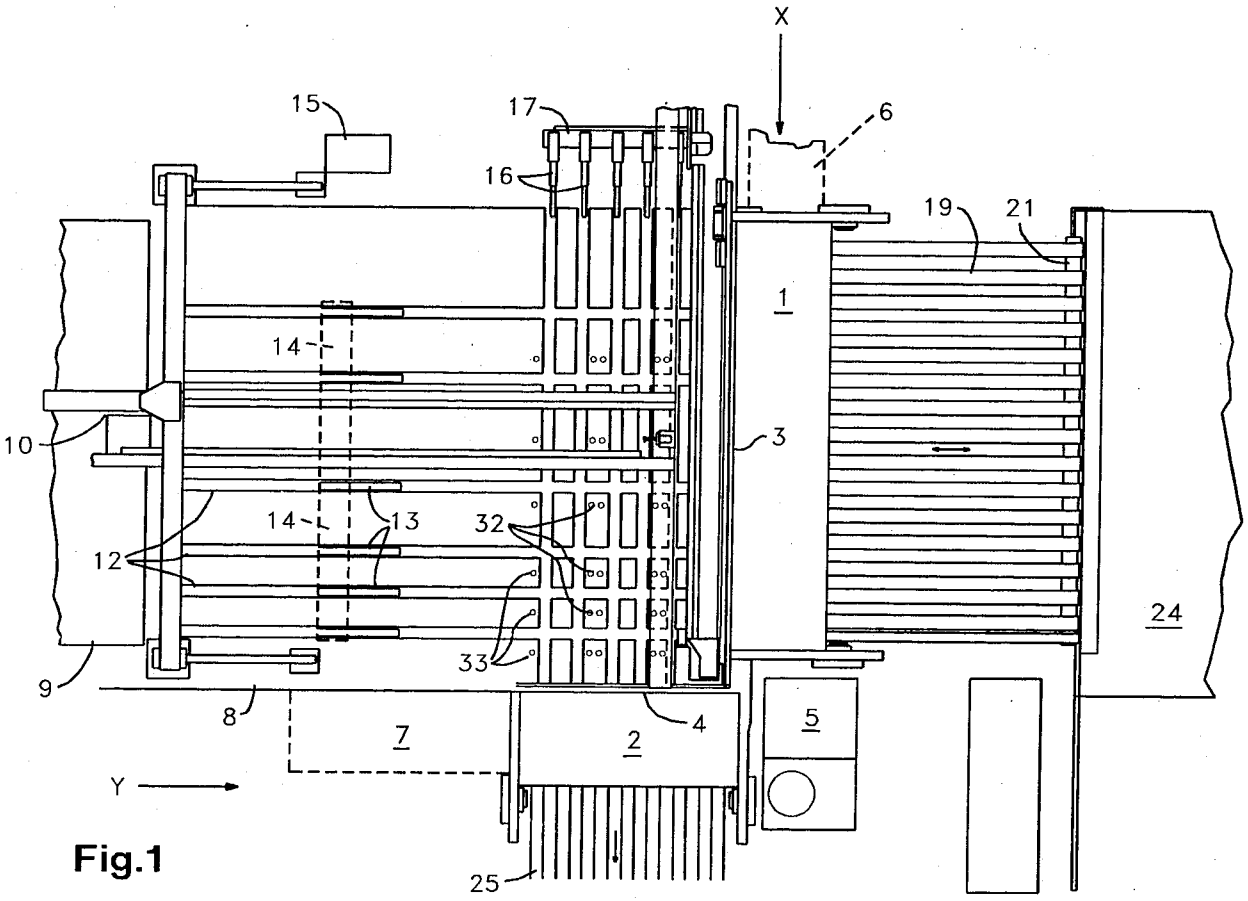
FIG. 1 shows schematically a top view of the apparatus.
Figure 2:
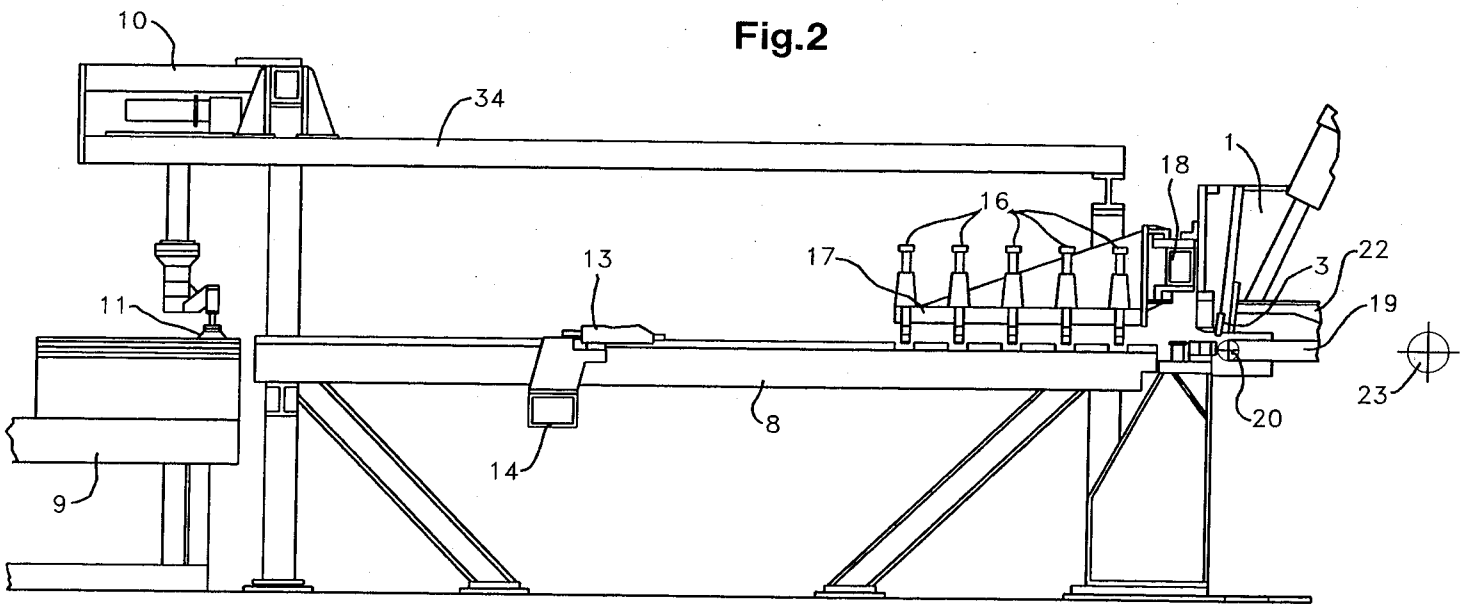
FIG. 2 shows a side view of the apparatus, seen in the X-direction.
Figure 3:
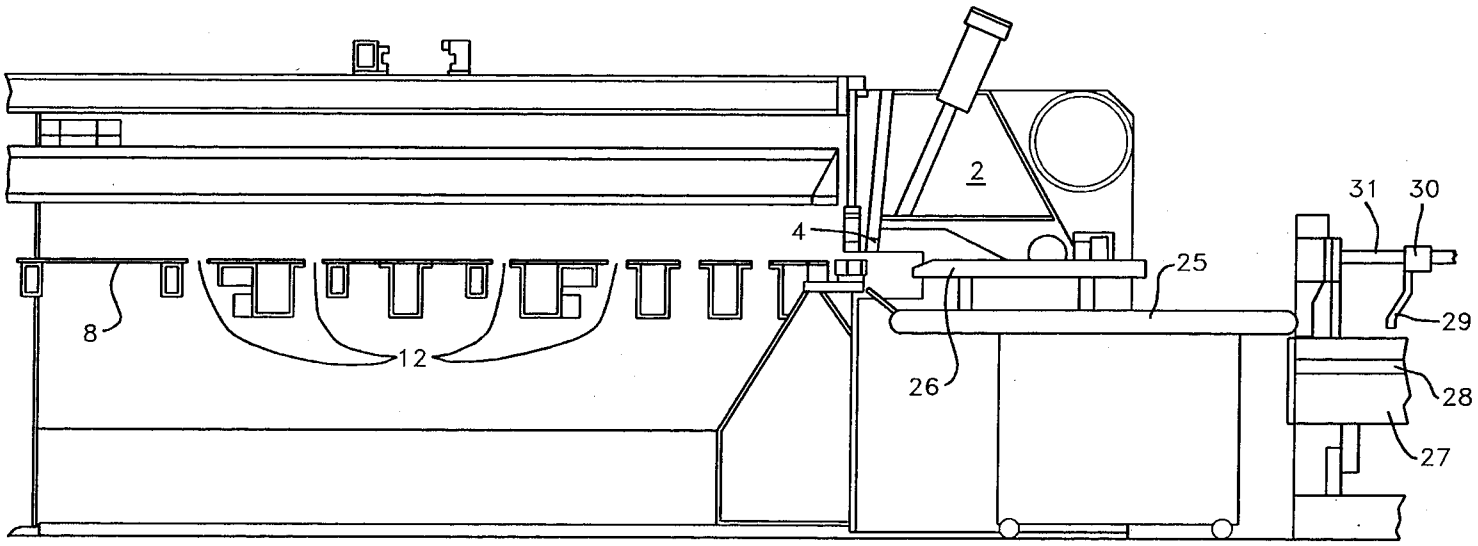
FIG. 3 shows schematically a side view of the apparatus in the Y-direction.

In FIG. 1 of the drawing designates a longitudinal direction and Y designates a transverse direction. The angle shear comprises a longitudinal cutting blade for cutting a metal piece fed in the Y-direction, and a transverse cutting blade 2 extending at a right angle to the longitudinal cutting blade. The longitudinal knive has a longitudinal blade member 3 and the transverse cutting blade has a transverse blade member 4. The longitudinal cutting blade 1 and the transverse knife 2 have a common hydraulic control 5 and are each equipped with a scrap box 6 and 7, respectively. The longitudinal cutting blade 1 and the transverse cutting blade 2 are associated with a common feed table 8, at the end of which spaced from the longitudinal cutting blade, is a lifting platform 9. Above the lifting platform is arranged, on a suction head slide 10, a suction head 11, which can be raised, lowered and rotated. The suction head slide is movable on a transverse guide 34 above the feed table 8. The parts 10, 11 and 34, together, form a feeder for metal sheets stacked on the lifting platform 9 by guiding side and front stops. The lifting platform 9, in the known way, is designed so that it raises automatically to bring the topmost sheet to the level of the feed table 8. The suction head 11, which can be lowered and rotated, engages a side of the topmost metal sheet, bends the sheet slightly and lifts it. Thereafter, the suction head slide 10 advances in the Y-direction and draws the sheet onto the feed table 8. The feed table 8 is provided with circular rollers (not shown).

The table 8 is provided with continuous grooves 12 extending in the Y-direction and in which are arranged Y-grippers 13 which can be lowered and raised to grip a metal sheet edge. These Y-grippers can also form, in common, a stop, when the metal sheet is turned in the X-direction. Beneath the table 8, there is a cross-beam 14 to which the Y-grippers can be fastened so that they can be raised or lowered. The cross-beam 14 is movable in the Y-direction and forms feeding means for the Y-grippers 13. The entire control takes place from a control panel 15.

To effect feeding in the X-direction, there are provided above the table surface and opposite the transverse cutting blade, four X-grippers 16 also arranged on a common longitudinal beam 17, which can be pushed and positioned in the X-direction. The grippers 16 are located above the surface of the table 8 and can be, respectively, raised and lowered to grip the piece of sheet metal. The longitudinal beam 17 is pushed along a guide beam 18 provided with corresponding slide rails.

Immediately behind the cutting edge of the longitudinal blade member 3, there is a conveyor belt means 19 which runs in the Y-direction and is moved by rotatable rollers 20 and 21. The conveyor belt means 19 is also connected with a pivotable housing 22 of the longitudinal blade member 3. During cutting motion, the housing 22 pivots about the shaft 23, the arrangement being such that during the cutting motion, that is, upon pivoting counterclockwise, the conveyor belt means 19 also pivots in the same direction and is lowered below the table surface. In the initial position shown, the upper part of the conveyor belt means 19 coincides with the upper surface of the feed table 8. During the cutting process, the conveyor belt means 19 is pivoted downward, as described, toward the longitudinal blade member 3. At the end of the conveyor belt means remote from the blade member, there is a stacker 24 with transverse conveyor rolls having axes extending in the Y-direction (not shown).

After the transverse blade member 4 of the transverse cutting blade 2, there is also a conveyor belt means 25 arranged behind the transverse blade member 4. The front part of belt means 25 is lowered in relation to the table surface. An adjustable stop device 26, known per se, is provided in the table. Behind the conveyor belt 25, again, there is a lifting platform 27 equipped with a rolling conveyor 28. After the rolling conveyor 28, an adjustable stop 29 is provided. The stop 29 is adjusted in the X-direction by being movable by a guide 30 along a guide rod 31.

On the surface of the feed table 8 are also arranged stops 32 and 33, which can be retracted. The side stops 32 and 33 are arranged and distributed within a plane which is limited in the longitudinal and transverse directions X and Y by the longitudinal knife 1, the transverse knife 2, the Y-grippers 13, and the X-grippers 16. The side stops can be lifted from the lowered position into the position of use. Each stop has a roller which, in use, abuts the edge of the guided metal sheet. This roller is being supported by a back-up pivotal roll and a support bracket arranged beneath it. This back-up roll and the support bracket form a clamping device for the metal sheet. In one position of the back-up roll, the metal sheet can be guided between the latter and the support bracket and in the second position, the metal sheet is clamped between the support bracket and the back-up roll.

By arranging the side stops in a row, it is possible to guide a metal sheet, according to the size and purpose of use, along different side stops, so that forming of several stacks of sheet metal sections, side-by-side, is possible. The sheet metal sections may be placed, therefore, in several stacks at different points, and the handling of the metal sheets is also facilitated.

A rotating device, equipped with a suction head and displaceable in the longitudinal and transverse directions above the feed table, further facilitate sheet handling.

The described angle shear has a sheet feeding system which comprises as described a feeding slide equipped with grippers arranged in the X- and Y-directions. The grippers are hydraulically actuated in the known way, and the grippers of the Y-feeder can be retracted beneath the table surface, while the grippers of the X-feeder can be raised, so that in their retracted or raised positions, the Y- and X-grippers can cross without collision. If the metal sheet must be rotated by the suction head, the grippers are in their retracted and raised, respective, positions, during this rotation, and the sheet can be freely rotated.

To cut a plate in one run, the metal sheet is placed by the suction head 11 of the suction head slide 10 on the feed table 8. Then the Y-grippers 13 grip a respective edge and push the sheet under the longitudinal blade member 3 in the direction of the conveyor belt means 19, until the width of a cut strip between the blade member base and the grippers is reached. Then longitudinal cutting takes place, upon which the plate is carried back along the raised side stops 22, 23 by the conveyor belt, which is now operated in the opposite direction. After the Y-grippers have been released and retracted, the X-grippers are actuated to hold the plate and to advance it in the X-direction, beneath the transverse cutting blade. The side stops 22, 23 again provide a correct guiding. Then the plates are cut and ejected onto a stacking station. At the same time, the Y-grippers travel forward again, grip the remaining sheet, which is fed to the Y-grippers grippers by the conveyor belt, now running backward. It should also be mentioned that two kinds of side stops are used. The side stops 32 catch and guide both to right and left, and the side stops 33 guide or catch only on one side.

Smaller plates also are cut in one run, in which case, after the longitudinal cut, the cut plate is pushed by the Y-feeder means, into one of the three side guides 32, 33, which can be lifted. The head of the side guides are provided with guiding rolls and pneumatic clamping rolls, which, in pushing the plate forward in the direction of the transverse cutting blade, guide the plate and press it against the side guide rolls, so that exactly rectangular cuts result. After the introduction into the side guides, the Y-grippers are released and retracted below the surface of the table, while at the same time, the plate is gripped by the X-grippers in accordance with the plate width and pushed beneath the transverse cutting blade to be cut. The side guides are arranged perpendicular to the longitudinal cutting blade at three different distances, and make possible the ejection of plates at three places, which can be selected through the control, so that it is possible to produce up to three stacks, side-by-side, according to plate format.

The conveyor belt means behind the longitudinal cutting blade also serves as a stacking device, and carries the cut-off plate or the remainder of the sheet forward. Since the conveyor belt means is automatically lowered during cutting, room is made for the descending upper blade member, and the sheet sections conveyed for stacking are stacked on the lifting platform equipped with a rolling conveyor. The lifting platform can be automatically adjusted in height, while, after reaching the allowed stack height, the lifting platform is automatically lowered and the stack is carried away. The stacking device of the transverse cutting blade also comprises conveyor belt means with a constant height, with raised sheet supports, as well as a stacker located behind and having a rolling conveyor and a height-adjustable stacking platform. The stacking platform may comprise a vertically liftable slide with a number of forks, which pick up sheet sections after the conveyor belt according to a minimum height of fall of the sheet sections. The forks are moved automatically according to the stack growth. When the stack height ist reached, the forks are retracted between the rolls of the rolling conveyor, so that the stack can be moved, either directly or on a pallet.

I claim:

1. An angle shear for cutting a sheet metal plate in two directions comprising:

a feed table having longitudinally extending grooves therein;

longitudinal and transverse cutting blade means arranged at one end of the feed table;

longitudinal feeding means located in the longitudinally extending grooves in the feed table, the longitudinal feeding means being movable between an extended position in which the longitudinal feeding means are above the feed table surface, and a retracted position in which the longitudinally extending means are beneath the feed table surface;

transverse feeding means arranged above the feed table and movable transverse to the longitudinal extent of the feed table; and a plurality of side stops arranged in a plane which is limited by the longitudinal and transverse cutting blade means.

2. An angle shear as set forth in claim 6 further comprising first and second stacking devices arranged behind the longitudinal and transverse cutting blade means, respectively, at least one of the first and second stacking devices comprising a conveyor belt movable in opposite directions toward and away from the respective cutting blade means and movable up and down, the conveyor belt with the movement of the respective cutting blade means.

3. An angle shear as set forth in claim 1 or 2 and further comprising a lifting platform located at the end of feed table which is opposite to the end at which the longitudinal and transverse cutting blade means is located, a transverse guide arranged above the feed table, a suction head slide movable along the transverse guide, and a suction head connected with the suction head slide for movement therewith, the suction head being rotatable and movable in a vertical direction to and away from the lifting platform.

4. An angle shear as set forth in claim 1 or 2 wherein the side stops are arranged on the feed table surface and are movable to an extended position in which they extend above the feed table surface.

5. An angle shear as set forth in claim 4 wherein each side stop comprises a side guide roll pivotable between two position, a back-up roll, and a support bracket arranged beneath the back-up roll, the back-up roll and the support bracket forming a clamp for a metal sheet to be cut.

* * * * *

UNITED STATES PATENT AND TRADEMARK OFFICE

CERTIFICATE OF CORRECTION

PATENT NO. : 4,815,349

DATED : March 28, 1989

INVENTOR(S) : Waelchli, Urs

It is certified that error appears in the above-identified patent and that said Letters Patent is hereby corrected as shown below:

Column 4, Line 40, Claim 2: The number "6" should be changed to a number "1".

Signed and Sealed this

Fourteenth Day of November, 1989

*Attest:*

JEFFREY M. SAMUELS

*Attesting Officer*

*Acting Commissioner of Patents and Trademarks*